US011939692B2

(12) United States Patent
Nakagawa et al.

(10) Patent No.: US 11,939,692 B2
(45) Date of Patent: Mar. 26, 2024

(54) STEEL SHEET FOR CAN MAKING AND METHOD FOR MANUFACTURING THE SAME

(71) Applicant: JFE STEEL CORPORATION, Tokyo (JP)

(72) Inventors: Yusuke Nakagawa, Tokyo (JP); Hanyou Sou, Tokyo (JP); Yoichiro Yamanaka, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 387 days.

(21) Appl. No.: 17/271,967

(22) PCT Filed: Jun. 7, 2019

(86) PCT No.: PCT/JP2019/022692
§ 371 (c)(1),
(2) Date: Feb. 26, 2021

(87) PCT Pub. No.: WO2020/044714
PCT Pub. Date: Mar. 5, 2020

(65) Prior Publication Data

US 2021/0324532 A1 Oct. 21, 2021

(30) Foreign Application Priority Data

Aug. 29, 2018 (JP) ..... 2018-159831

(51) Int. Cl.
*C25D 5/18* (2006.01)
*C25D 3/08* (2006.01)
(Continued)

(52) U.S. Cl.
CPC ..... *C25D 5/18* (2013.01); *C25D 3/08* (2013.01); *C25D 3/12* (2013.01); *C25D 5/12* (2013.01);
(Continued)

(58) Field of Classification Search
None
See application file for complete search history.

(56) References Cited

U.S. PATENT DOCUMENTS 4,731,301 A * 3/1988 Higuchi ..... C23C 2/02 428/648
4,999,258 A * 3/1991 Wake ..... C25D 5/10 428/658
(Continued)

FOREIGN PATENT DOCUMENTS

CN 1681971 A 10/2005
EP 1544326 A1 6/2005
(Continued)

OTHER PUBLICATIONS

Jun. 1, 2020 Office Action issued in Taiwanese Patent Application No. 108121227.
(Continued)

*Primary Examiner* — Seth Dumbris
(74) *Attorney, Agent, or Firm* — Oliff PLC

(57) ABSTRACT

A steel sheet for can making and methods for manufacturing the same. The steel sheet includes, in order from a steel sheet side, an iron-nickel diffusion layer, a metallic chromium layer, and a chromium oxide layer. The iron-nickel diffusion layer has a nickel coating weight of 50 mg/m$^2$ to 500 mg/m$^2$ per surface of the steel sheet and a thickness of 0.060 μm to 0.500 μm per surface of the steel sheet. The metallic chromium layer includes a flat-like metallic chromium sublayer and a granular metallic chromium sublayer placed on a surface of the flat-like metallic chromium sublayer. The total chromium coating weight of both sublayers per surface of the steel sheet is 60 mg/m$^2$ to 200 mg/m$^2$. The chromium oxide layer has a chromium coating weight 3 mg/m$^2$ to 10 mg/m$^2$ per surface of the steel sheet in terms of metallic chromium.

1 Claim, 1 Drawing Sheet

(51) Int. Cl.

| | |
|---|---|
| ***C25D 3/12*** | (2006.01) |
| ***C25D 5/00*** | (2006.01) |
| ***C25D 5/12*** | (2006.01) |
| ***C25D 5/14*** | (2006.01) |
| ***C25D 5/36*** | (2006.01) |
| ***C25D 5/50*** | (2006.01) |
| ***C25D 9/06*** | (2006.01) |
| ***C25D 9/10*** | (2006.01) |
| ***C25D 11/38*** | (2006.01) |

(52) U.S. Cl.

CPC ..... *C25D 5/14* (2013.01); *C25D 5/36* (2013.01); *C25D 5/50* (2013.01); *C25D 5/605* (2020.08); *C25D 5/617* (2020.08); *C25D 5/627* (2020.08); *C25D 9/06* (2013.01); *C25D 9/10* (2013.01); *C25D 11/38* (2013.01); *Y10T 428/12611* (2015.01)

(56) References Cited

U.S. PATENT DOCUMENTS

| | | | | |
|---|---|---|---|---|
| 6,042,952 | A * | 3/2000 | Aratani | C21D 8/0226 148/320 |
| 2013/0071688 | A1 * | 3/2013 | Bessho | C23C 28/028 205/176 |
| 2018/0355496 | A1 | 12/2018 | Nakagawa et al. | |
| 2018/0363160 | A1 | 12/2018 | Nakagawa et al. | |

FOREIGN PATENT DOCUMENTS

| | | | |
|---|---|---|---|
| JP | S62-40396 | A | 2/1987 |
| JP | S63-76897 | A | 4/1988 |
| JP | S63-186894 | A | 8/1988 |
| JP | S63-238299 | A | 10/1988 |
| JP | H02-274866 | A | 11/1990 |
| JP | H03-75397 | A | 3/1991 |
| JP | 2009-52102 | A | 3/2009 |
| WO | 2017/098991 | A1 | 6/2017 |
| WO | 2017/098994 | A1 | 6/2017 |
| WO | 2017/221763 | A1 | 12/2017 |

OTHER PUBLICATIONS

Furuya, H. et al. "An Electrochemically Chromated Steel Sheet with Improved Weldability and a Method for Manufacturing the Sheet", Chemical Abstracts, vol. 109, No. 18, pp. 624, 1988.

Jul. 23, 2021 Extended European Search Report issued in European Patent Application No. 19854414.0.

Sep. 3, 2019 International Search Report issued in International Application No. PCT/JP2019/022692.

Jun. 15, 2022 Office Action issued in Korean Patent Application No. 10-2021-7005748.

Feb. 7, 2023 Office Action issued in Chinese Patent Application No. 201980056718.3.

* cited by examiner

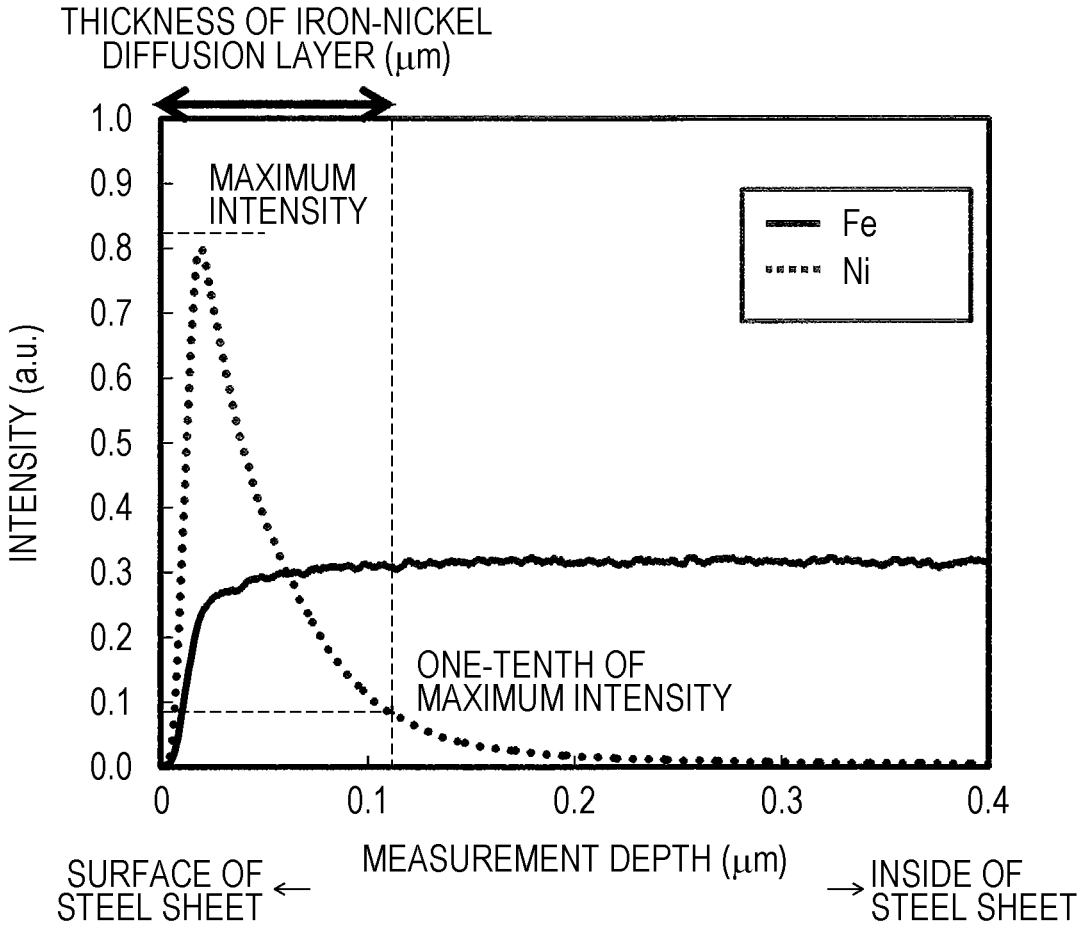
THICKNESS OF IRON-NICKEL DIFFUSION LAYER (μm)
MAXIMUM INTENSITY
Fe
Ni
INTENSITY (a.u.)
1.0
0.9
0.8
0.7
0.6
0.5
0.4
0.3
0.2
0.1
0.0
ONE-TENTH OF MAXIMUM INTENSITY
0
0.1
0.2
0.3
0.4
MEASUREMENT DEPTH (μm)
SURFACE OF STEEL SHEET ←
→ INSIDE OF STEEL SHEET

STEEL SHEET FOR CAN MAKING AND METHOD FOR MANUFACTURING THE SAME

TECHNICAL FIELD

This application relates to a steel sheet for can making, the steel sheet being used for welded can bodies, and methods for manufacturing the same.

BACKGROUND

Cans which are containers applied to beverages and foods are used all over the world because the contents thereof can be stored for a long time. The cans can be broadly divided into two-piece cans which are obtained in such a manner that a can bottom and a can body are integrally formed by drawing, ironing, stretching, and bending a metal sheet, followed by seaming the can body with an upper lid, and three-piece cans which are obtained in such a manner that a metal sheet is worked into a cylindrical form and is welded into a can body by a wire seam process, followed by seaming both ends of the can body with lids. Can bodies with a large diameter are often beaded so as to have can strength. In recent years, cans having a variety of body shapes formed by embossing or expanding a can body for the purpose of improving a design to compete other material containers such as aluminum cans and PET bottles have been evolved.

Hitherto, Sn-plated steel sheets (so-called tinplate) excellent in weldability and corrosion resistance have been widely used as steel sheets for can making. In recent years, the range of application of electrolytically chromated steel sheets (hereinafter also referred to as tin-free steel (TFS)) including a metallic chromium layer and a layer (hereinafter referred to as a chromium oxide layer) containing chromium oxide and hydrated chromium oxide has been expanding because the electrolytically chromated steel sheets are less expensive and are more excellent in lacquer adhesion than tinplate.

At present, TFS can be welded in such a manner that a surface chromium oxide layer which is an insulating film is removed by mechanical polishing immediately before welding. However, in industrial production, there are many problems such as the risk that the contents are contaminated with a metal powder after polishing, an increase in maintenance load such as the cleaning of a can-making machine, and the risk of occurrence of fire due to the metal powder. Furthermore, since TFS cannot be expected to have sacrificial protection ability like tinplate, treatment such as repair coating needs to be performed after working depending on the contents in consideration of the risk of such damage to a plated film that a base metal is exposed in a worked portion.

For these problems of TFS, for example, Patent Literature 1 proposes a technique for welding TFS without polishing. The technique disclosed in Patent Literature is a technique in which a large number of defects are formed in a metallic chromium layer by performing an anodic electrolytic treatment between anterior and posterior cathodic electrolytic treatments and metallic chromium is formed into granular protrusions by the posterior cathodic electrolytic treatment. According to this technique, the granular protrusions of metallic chromium break a chromium oxide layer which is a surface welding inhibition factor during welding, thereby enabling the contact resistance to be reduced and the weldability to be improved.

Patent Literature 2 proposes a technique in which excellent weldability can be ensured in such a manner that a metallic chromium layer and a hydrated chromium oxide layer formed on a Ni layer in the form of flat-like layers having no granular protrusions.

Furthermore, Patent Literatures 3 and 4 disclose a steel sheet for can making, the rust resistance and weldability of the steel sheet being ensured and the surface appearance thereof being improved by reducing the diameter of granular protrusions of a metallic chromium layer.

CITATION LIST

Patent Literature

PTL 1: Japanese Unexamined Patent Application Publication No. 63-186894

PTL 2: Japanese Unexamined Patent Application Publication No. 63-238299

PTL 3: International Publication No. 2017/098994

PTL 4: International Publication No. 2017/098991

SUMMARY

Technical Problem

However, in steel sheets for can making, the steel sheets being described in Patent Literatures 1 to 4, although the weldability can be improved, the post-working corrosion resistance is insufficient particularly in a severely worked portion of a can body and there is a problem in ensuring both the weldability and the post-working corrosion resistance.

The disclosed embodiments have been made in view of the above circumstances and it is an object of the disclosed embodiments to provide a steel sheet for can making, the steel sheet being excellent in weldability and post-working corrosion resistance, and a method for manufacturing the same.

Solution to Problem

The inventors have carried out intensive investigations to achieve the above object. As a result, the inventors have found that excellent weldability and post-working corrosion resistance can be both ensured in such a manner that an iron-nickel diffusion layer are allowed to be present on a surface of a steel sheet and a metallic chromium layer having specific granular protrusions and a chromium oxide layer are formed on or above the iron-nickel diffusion layer.

The disclosed embodiments are summarized below.

[1] A steel sheet for can making includes an iron-nickel diffusion layer, a metallic chromium layer, and a chromium oxide layer on at least one surface of the steel sheet in order from the steel sheet side.

The iron-nickel diffusion layer has a nickel coating weight of 50 $mg/m^2$ to 500 $mg/m^2$ per surface of the steel sheet and a thickness of 0.060 μm to 0.500 μm per surface of the steel sheet.

The metallic chromium layer includes a flat-like metallic chromium sublayer and a granular metallic chromium sublayer placed on a surface of the flat-like metallic chromium sublayer, the total chromium coating weight of both per surface of the steel sheet is 60 $mg/m^2$ to 200 $mg/m^2$, and the granular metallic chromium sublayer further includes granular protrusions having a number density of 5 $\mu m^{-2}$ or more per unit area and a maximum diameter of 150 nm or less. The chromium oxide layer has a chromium coating weight of 3 mg/m$^2$ to 1.0 mg/m$^2$ per surface of the steel sheet in terms of metallic chromium.

[2] A method for manufacturing a steel sheet for can making includes nickel-plating a cold-rolled steel sheet; annealing the cold-rolled steel sheet; subjecting the steel sheet to an anterior cathodic electrolytic treatment using an aqueous solution containing a hexavalent chromium compound, a fluorine-containing compound, and sulfuric acid or a sulfate; subsequently subjecting the steel sheet to an anodic electrolytic treatment; and further subsequently subjecting the steel sheet to a posterior cathodic electrolytic treatment.

[3] A method for manufacturing a steel sheet for can making includes nickel-plating a cold-rolled steel sheet, annealing the cold-rolled steel sheet, subjecting the steel sheet to an anterior cathodic electrolytic treatment using an aqueous solution which contains a hexavalent chromium compound and a fluorine-containing compound and which contains no sulfuric acid or sulfate except sulfuric acid or a sulfate that is inevitably contained, subsequently subjecting the steel sheet to an anodic electrolytic treatment, and further subsequently subjecting the steel sheet to a posterior cathodic electrolytic treatment.

Advantageous Effects

According to the disclosed embodiments, a steel sheet for can making, the steel sheet being excellent in weldability and post-working corrosion resistance, is obtained.

BRIEF DESCRIPTION OF THE DRAWINGS

FIG. 1 is a graph showing an example of analysis results of an iron-nickel diffusion layer by GDS in a depth direction.

DETAILED DESCRIPTION

A steel sheet for can making according to the disclosed embodiments includes an iron-nickel diffusion layer, a metallic chromium layer, and a chromium oxide layer on at least one surface of the steel sheet in order from the steel sheet side. The iron-nickel diffusion layer has a nickel coating weight of 50 mg/m$^2$ to 500 mg/m$^2$ per surface of the steel sheet and a thickness of 0.060 μm to 0.500 μm per surface of the steel sheet. The metallic chromium layer includes a flat-like metallic chromium sublayer and a granular metallic chromium sublayer placed on a surface of the flat-like metallic chromium sublayer and the total chromium coating weight of both per surface of the steel sheet is 60 g/m$^2$ to 200 mg/m$^2$. Furthermore, the granular metallic chromium sublayer includes granular protrusions having a number density of 5 μm$^{-2}$ or more per unit area and a maximum diameter of 150 nm or less. The chromium oxide layer has a chromium coating weight of 3 mg/m$^2$ to 10 mg/m$^2$ per surface of the steel sheet in terms of metallic chromium Configurations of the disclosed embodiments are described below in detail.

(Steel Sheet)

The type of a steel sheet that is a base material for the steel sheet for can making according to the disclosed embodiments is not particularly limited. A steel sheet (for example, a low-carbon steel sheet or an ultra-low-carbon steel sheet) usually used as a container material can be used. A method for manufacturing this steel sheet, material therefor, and the like are not particularly limited. This steel sheet is manufactured through steps such as hot rolling, pickling, cold rolling, annealing, and temper rolling from a usual semi-finished product-manufacturing step.

(Iron-Nickel Diffusion Layer)

The steel sheet for can making according to the disclosed embodiments includes the iron-nickel diffusion layer on at least one surface of the steel sheet.

In the disclosed embodiments, the presence of the iron-nickel diffusion layer on at least one surface of the steel sheet allows the occurrence of cracks in a surface of the steel sheet in a severely worked portion of a can body to be remarkably suppressed. Alternatively, even if cracks occur, the exposure of a base metal is suppressed by the iron-nickel diffusion layer, thereby enabling the post-working corrosion resistance to be significantly enhanced. When the iron-nickel diffusion layer is present on a surface of the steel sheet, as compared to when the iron-nickel diffusion layer is not present, the control of the chromium coating weight of the metallic chromium layer, which is placed thereon, the number density of the granular protrusions per unit area and the maximum diameter of the granular protrusions is easier. Therefore, in the disclosed embodiments, the presence of the iron-nickel diffusion layer is advantageous in ensuring excellent weldability.

A mechanism (assumed) in which the post-working corrosion resistance is enhanced in a severely worked portion such as a can body by the iron-nickel diffusion layer is further described below in detail. In the can body subjected to working such as beading, embossing, or expanding as described in Background Art, a plated film of a surface layer of the steel sheet is assumed to be damaged depending on the degree of working. In particular, expanding is extremely severe working in which the diameter of a can is increased by several percent to ten-odd percent; hence, cracks are assumed to locally reach the steel sheet and the steel sheet, which is a base, is exposed. For a case with chromium only plating, when the steel sheet is exposed, corrosion proceeds with the steel sheet serving as an anode and a cross section of the chromium plating and surfaces of the surroundings thereof serving as a cathode. Even if a nickel plating is present under the chromium plating, the nickel only plating cannot prevent the progress of cracks and corrosion proceeds with the steel sheet serving as an anode as is the case with the chromium only plating. Since pinholes are inherently present in the nickel plating, considerable coating weight is necessary to completely cover the steel sheet, leading to an increase in manufacturing cost. However, the iron-nickel diffusion layer, which is used in the disclosed embodiments, is such that nickel is diffused in a deeper portion of the steel sheet as compared to the nickel only plating; hence, even if similar cracks reach the steel sheet, it is conceivable that an electrochemically relatively stable state is maintained and the post-working corrosion resistance is excellent because the potential difference between the chromium plating (the metallic chromium layer and the chromium oxide layer), which is an upper layer, and the iron-nickel diffusion layer is small.

In the disclosed embodiments, in order to obtain excellent post-working corrosion resistance, the nickel coating weight of the iron-nickel diffusion layer per surface of the steel sheet is 50 mg/m$^2$ to 500 mg/m$^2$. When the nickel coating weight is less than 50 mg/m$^2$, the post-working corrosion resistance is insufficient. When the nickel coating weight is more than 500 mg/m$^2$, the effect of enhancing the post-working corrosion resistance is saturated and manufacturing costs are high. The nickel coating weight of the iron-nickel diffusion layer per surface of the steel sheet is preferably 70 mg/m$^2$ or more and more preferably 200 mg/m$^2$ or more.

The nickel coating weight of the iron-nickel diffusion layer per surface of the steel sheet is preferably 450 mg/m$^2$ or less.

In the disclosed embodiments, in order to obtain excellent post-working corrosion resistance, the thickness of the iron-nickel diffusion layer per surface of the steel sheet is 0.060 μm to 0.500 μm. When the thickness is less than 0.060 μm, the post-working corrosion resistance is insufficient. When the thickness is more than 0.500 μm, the effect of enhancing the post-working corrosion resistance is saturated and manufacturing costs are high. The thickness of the iron-nickel diffusion layer per surface of the steel sheet is preferably 0.100 μm or more and more preferably 0.200 μm or more. The thickness of the iron-nickel diffusion layer per surf ace of the steel sheet is preferably 0.46 μm or less.

The thickness of the iron-nickel diffusion layer can be measured by GDS (glow discharge spectroscopy). In particular, first, a surface of the iron-nickel diffusion layer is sputtered toward the inside of the steel sheet, followed by analysis in a depth direction, whereby the sputtering time is determined such that the intensity of Ni is one-tenth of the maximum. Next, the relationship between the sputtering depth and the sputtering time is determined by GDS using pure iron. This relationship is used to calculate the sputtering depth in terms of pure iron from the sputtering time that the intensity of Ni is one-tenth of the maximum as determined in advance and a calculated value is taken as the thickness of the iron-nickel diffusion layer (FIG. 1).

(Metallic Chromium Layer)

The steel sheet for can making according to the disclosed embodiments includes the metallic chromium layer, which is placed on a surface of the iron-nickel diffusion layer as described above. The metallic chromium layer, which is used in the disclosed embodiments, includes the flat-like metallic chromium sublayer and the granular metallic chromium sublayer, which is placed on a surface of the flat-like metallic chromium sublayer.

The role of metallic chromium in general TFS is to suppress the surface exposure of the steel sheet, which is a base material, to enhance the corrosion resistance. When the amount of metallic chromium is too small, the exposure of the steel sheet cannot be avoided and the corrosion resistance deteriorates in some cases.

In the disclosed embodiments, the total chromium coating weight of the flat-like metallic chromium sublayer and the granular metallic chromium sublayer per surface of the steel sheet is 60 mg/m$^2$ or more because the corrosion resistance of the steel sheet for can making is excellent. Incidentally, the total chromium coating weight is preferably 70 mg/m$^2$ or more and more preferably 80 mg/m$^2$ or more because the corrosion resistance is more excellent.

However, when the total chromium coating weight of the flat-like metallic chromium sublayer and the granular metallic chromium sublayer per surface of the steel sheet is too large, metallic chromium, which has a high melting point, covers the entire surface of the steel sheet; hence, the reduction of weld strength during welding and the occurrence of dust are significant and the weldability deteriorates in some cases. Thus, in the disclosed embodiments, the total chromium coating weight of the flat-like metallic chromium sublayer and the granular metallic chromium sublayer per surface of the steel sheet is 200 mg/m$^2$ or less because the weldability of the steel sheet for can making is excellent. Incidentally, the total chromium coating weight is preferably 180 mg/m$^2$ or less and more preferably 160 mg/m$^2$ or less because the weldability is more excellent.

Next, the metallic chromium layer of the disclosed embodiments, the flat-like metallic chromium sublayer and the granular metallic chromium sublayer which is placed on a surface of the flat-like metallic chromium sublayer, are described below in detail.

(Flat-Like Metallic Chromium Sublayer)

The flat-like metallic chromium sublayer mainly plays a role in covering a surface of the steel sheet to enhance the corrosion resistance.

In the disclosed embodiments, the flat-like metallic chromium sublayer preferably has sufficient thickness, in addition to corrosion resistance generally required to TFS, such that the steel sheet is not exposed because the granular metallic chromium sublayer, which is placed on a surface, breaks the flat-like metallic chromium sublayer when portions of the steel sheet for can making inevitably touch each other during handling.

From this viewpoint, the inventors have subjected steel sheets for can making to a fretting test to investigate the rust resistance. As a result, the inventors have found that when the flat-like metallic chromium sublayer has a thickness of 7 nm or more, the rust resistance is excellent. That is, the thickness of the flat-like metallic chromium sublayer is preferably 7 nm or more because the rust resistance of the steel sheet for can making is excellent, more preferably 9 nm or more because the rust resistance thereof is more excellent, and further more preferably 10 nm or more.

On the other hand, the lower limit of the thickness of the flat-like metallic chromium sublayer is not particularly limited and is preferably 20 nm or less and more preferably 15 nm or less.

The thickness of the flat-like metallic chromium sublayer may be measured as described below.

First, a cross-sectional sample of the steel sheet for can making, the steel sheet being provided with the metallic chromium layer and the chromium oxide layer, is prepared by a focused ion beam (FIB) method and is observed with a scanning transmission electron microscope (TEM) at 20,000× magnification. Subsequently, a portion having no granular protrusions but the flat-like metallic chromium sublayer only is focused in the observation of a cross-sectional shape in a bright field image and the thickness of the flat-like metallic chromium sublayer is determined from the intensity curve (horizontal axis: distance, vertical axis: intensity) of each of chromium and iron by line analysis by an energy dispersive X-ray spectroscopy (EDX). In this operation, in more detail, a point where an intensity is 20% of a maximum value in an intensity curve of chromium is taken as an outermost layer, the crossing point of the intensity curve of chromium and the intensity curve of iron is taken as a boundary point with iron, and the distance between the two points is taken as the thickness of the flat-like metallic chromium sublayer.

The coating weight of the flat-like metallic chromium sublayer is preferably 10 mg/m$^2$ or more, more preferably 30 mg/m$^2$ or more, and further more preferably 40 mg/m$^2$ or more because the rust resistance of the steel sheet for can making is excellent.

(Granular Metallic Chromium Sublayer)

The granular metallic chromium sublayer is a metallic chromium sublayer with granular protrusions placed on a surface of the above-mentioned flat-like metallic chromium sublayer and mainly plays a role in reducing the contact resistance between the steel sheets for can making themselves to enhance the weldability. An assumed mechanism in which the contact resistance is reduced is as described below.

Since the chromium oxide layer, which is covered on the metallic chromium layer, is a non-conductive film, the chromium oxide layer has an electrical resistance higher than that of the metallic chromium layer and serves as a welding inhibitor. Forming the granular protrusions on a surface of the metallic chromium layer significantly reduces the contact resistance because the granular protrusions break the chromium oxide layer by the surface pressure at the contact between the steel sheets for can making themselves during welding and serve as conduction points of a welding current. On the other hand, when the number of the granular protrusions of the granular metallic chromium sublayer is too small, the number of conduction points during welding decrease, the contact resistance cannot be reduced, and the weldability is poor in some cases.

In the disclosed embodiments, the granular metallic chromium sublayer includes the granular protrusions such that the number density of the granular protrusions per unit area is 5 $\mu m^{-2}$ or more and the maximum diameter of the granular protrusions is 150 nm or less.

The number density of the granular protrusions per unit area is 5 $\mu m^{-2}$ or more because the weldability of the steel sheet for can making is excellent. The number density of the granular protrusions per unit area is preferably 10 $\mu m^{-2}$ or more, more preferably 20 $\mu m^{-2}$ or more, further more preferably 30 $\mu m^{-2}$ or more, particularly preferably 50 $\mu m^{-2}$ or more, and most preferably 100 $\mu m^{-2}$ or more because the weldability of the steel sheet for can making is more excellent.

The upper limit of the number density of the granular protrusions per unit area, because color tone and the like may be affected when the number density of the granular protrusions per unit area is too large, is preferably 10,000 $m^{-2}$ or less, more preferably 5,000 $\mu m^{-2}$ or less, further more preferably 1,000 $\mu m^{-2}$ or less, and particularly preferably 800 $\mu m^{-2}$ or less and the surface appearance of the steel sheet for can making is more excellent.

Incidentally, the inventors have found that when the maximum diameter of the granular protrusions is too large, the hue of the steel sheet for can making is affected, a brown pattern appears, and the surface appearance is poor. This is probably because the granular protrusions absorb short-wavelength (blue) light, reflected light thereof attenuates, and therefore a reddish brown color is exhibited or because the granular protrusions scatter reflected light to reduce the overall reflectance to increase darkness.

Therefore, in the disclosed embodiments, the maximum diameter of the granular protrusions of the granular metallic chromium sublayer is 150 nm or less. This allows the surface appearance of the steel sheet for can making to be excellent. This is probably because the reduction in diameter of the granular protrusions suppresses the absorption of short-wavelength light and the scattering of reflected light. The maximum diameter of the granular protrusions of the granular metallic chromium sublayer is preferably 100 nm or less, more preferably 80 nm or less, and further more preferably 50 nm or less because the surface appearance of the steel sheet for can making is more excellent. The lower limit of the maximum diameter thereof is not particularly limited and is preferably 10 nm or more.

The maximum diameter of the granular protrusions and the number density of the granular protrusions per unit area may be measured as described below.

Carbon is vapor-deposited on a surface of the steel sheet for can making, the steel sheet being provided with the metallic chromium layer and the chromium oxide layer, followed by preparing an observation sample by an extraction replica method. Thereafter, the observation sample is photographed with a scanning transmission electron microscope (TEM) at 20,000× magnification. Image analysis is performed in such a manner that a taken photograph is binarized using software (trade name: ImageJ), whereby the diameter is converted in terms of a perfect circle and the number density per unit area are determined by inverse calculation from the area occupied by the granular protrusions. As the granular protrusions, protrusions with a height of 10 nm or more are defined as protrusions. In addition, the number density per unit area is the average of five fields of view and the maximum diameter of the granular protrusions is the maximum diameter in observation fields photographed in five fields of view at 20,000× magnification.

The coating weight of the metallic chromium layer (the total of the flat-like metallic chromium sublayer and the granular metallic chromium sublayer per surface of the steel sheet) and the coating weight of the chromium oxide layer, which is described below, in terms of chromium may be measured as described below.

First, the steel sheet for can making, the steel sheet being provided with the metallic chromium layer and the chromium oxide layer, is measured for the amount of chromium (the total amount of chromium) using an X-ray fluorescence spectrometer. Next, the steel sheet for can making is alkali-treated in such a manner that the steel sheet for can making is immersed in 6.5 N NaOH at 90° C. for ten minutes, followed by measuring the amount of chromium (the amount of chromium after alkali treatment, using the X-ray fluorescence spectrometer again. The amount of chromium after alkali treatment is taken as the coating weight of the metallic chromium layer.

Next, the equation (amount of alkali-soluble chromium) =(total amount of chromium)−(amount of chromium after alkali treatment) is calculated. The amount of alkali-soluble chromium is taken as the coating weight of the chromium oxide layer in terms of chromium.

(Chromium Oxide Layer)

The steel sheet for can making according to the disclosed embodiments further includes the chromium oxide layer on a surface of the metallic chromium layer.

Chromium oxide precipitates on a surface of a steel sheet together with metallic chromium and mainly plays a role in enhancing the corrosion resistance. In the disclosed embodiments, the chromium oxide layer has a chromium coating weight of 3 $mg/m^2$ or more per surface of the steel sheet in terms of metallic chromium because the corrosion resistance of the steel sheet for can making is ensured.

On the other hand, the chromium oxide layer has poorer electrical conductivity as compared to metallic chromium. When the amount of chromium oxide is too large, chromium oxide acts as an excessive resistance during welding and causes various welding defects such as generation of dust and splash, and blowholes due to overfusion welding, and the weldability of the steel sheet for can making is poor in some cases.

Therefore, in the disclosed embodiments, the chromium coating weight of the chromium oxide layer per surface of the steel sheet is 10 $mg/m^2$ or less in terms of metallic chromium because the weldability of the steel sheet for can making is excellent. The chromium coating weight thereof is preferably 8 $mg/m^2$ or less and more preferably 6 $mg/m^2$ or less because the weldability of the steel sheet for can making is more excellent.

A method for measuring the coating weight of the chromium oxide layer is as described above.

The steel sheet for can making according to the disclosed embodiments may include the iron-nickel diffusion layer, the metallic chromium layer, and the chromium oxide layer as described above as essential components and may arbitrarily include, for example, a covering layer such as an inorganic compound layer, a lubricant compound layer, or an organic resin layer in addition to those layers in the form of the uppermost layer or an intermediate layer depending on a purpose.

Next, methods for manufacturing the steel sheet for can making according to the disclosed embodiments are described.

The methods for manufacturing the steel sheet for can making according to the disclosed embodiments (hereinafter simply also referred to as the "manufacturing method according to the disclosed embodiments") are described. The method includes nickel-plating a cold-rolled steel sheet; annealing the cold-rolled steel sheet; subjecting the steel sheet to an anterior cathodic electrolytic treatment using an aqueous solution containing a hexavalent chromium compound, a fluorine-containing compound, and sulfuric acid or a sulfate; subsequently subjecting the steel sheet to an anodic electrolytic treatment, and further subsequently subjecting the steel sheet to a posterior cathodic electrolytic treatment. Alternatively, an aqueous solution containing no sulfuric acid or sulfate may be used. That is, the cold-rolled steel sheet is nickel-plated, is annealed, is subjected to the anterior cathodic electrolytic treatment using an aqueous solution which contains the hexavalent chromium compound and the fluorine-containing compound and which contains no sulfuric acid or sulfate except sulfuric acid or a sulfate that is inevitably contained, is subsequently subjected to the anodic electrolytic treatment, and is further subsequently subjected to the posterior cathodic electrolytic treatment. The manufacturing method according to the disclosed embodiments is described below.

First, in the disclosed embodiments, the cold-rolled steel sheet is nickel-plated and is then annealed. This forms the iron-nickel diffusion layer on a surface of the steel sheet. The cold-rolled steel sheet is nickel-plated before annealing and nickel is thermally diffused into the steel sheet simultaneously with the recrystallization of the steel sheet during annealing such that the iron-nickel diffusion layer is formed. In a case where nickel-plating is performed before annealing, the nickel coating weight by nickel-plating is not particularly limited and is preferably 50 $mg/m^2$ or more and more preferably 70 $mg/m^2$ or more in order to satisfy the nickel coating weight and desired thickness of the above-mentioned iron-nickel diffusion layer. The upper limit of the nickel coating weight is not particularly limited and is preferably 500 $mg/m^2$ or less from the viewpoint of manufacturing costs.

Next, after the iron-nickel diffusion layer is formed, the metallic chromium layer and the chromium oxide layer are formed on a surface of the iron-nickel diffusion layer. The metallic chromium layer and the chromium oxide layer are formed in such a manner that the steel sheet is subjected to the anterior cathodic electrolytic treatment using the aqueous solution containing the hexavalent chromium compound, the fluorine-containing compound, and sulfuric acid or the sulfate; is subsequently subjected to the anodic electrolytic treatment under predetermined conditions; and is further subsequently subjected to the posterior cathodic electrolytic treatment under predetermined conditions.

In general, in a cathodic electrolytic treatment in an aqueous solution containing a hexavalent chromium compound, a reduction reaction occurs on a surface of a steel sheet and metallic chromium and hydrated chromium oxide, which is an intermediate product of metallic chromium, precipitate on the surface thereof. The hydrated chromium oxide is nonuniformly dissolved by intermittently per forming an electrolytic treatment or by immersion in an aqueous solution of a hexavalent chromium compound for a long time and granular protrusions of metallic chromium are formed by a subsequent cathodic electrolytic treatment.

In the disclosed embodiments, the anodic electrolytic treatment is performed between the cathodic electrolytic treatments, so that metallic chromium is frequently dissolved over the entire surface of the steel sheet and forms origins of granular protrusions of metallic chromium that are formed by the subsequent cathodic electrolytic treatment. The flat-like metallic chromium sublayer is precipitated the anterior cathodic electrolytic treatment, which is a cathodic electrolytic treatment performed before the anodic electrolytic treatment, and the granular metallic chromium sublayer (granular protrusions) is precipitated in the posterior cathodic electrolytic treatment, which is a cathodic electrolytic treatment performed after the anodic electrolytic treatment.

The amount of precipitation of each can be controlled by electrolysis conditions for electrolytic treatments.

The aqueous solution used to form the metallic chromium layer and the chromium oxide layer on a surface of the iron-nickel diffusion layer and electrolytic treatment conditions are described below in detail.

(Aqueous Solution)

The aqueous solution, which is used in the manufacturing method according to the disclosed embodiments, contains the hexavalent chromium compound, the fluorine-containing compound, and sulfuric acid or the sulfate. Alternatively, an aqueous solution which contains the hexavalent chromium compound and the fluorine-containing compound and which contains no sulfuric acid or sulfate except sulfuric acid or a sulfate that is inevitably contained may be used.

When sulfuric acid or the sulfate is contained in the aqueous solution, the fluorine-containing compound and sulfuric acid in the aqueous solution are present in such a state that the fluorine-containing compound and sulfuric acid are dissociated into fluoride ions, sulfate ions, and hydrogen sulfate ions. These act as catalysts involved in the reduction and oxidation reactions of hexavalent chromium ions present in the aqueous solution, the reduction and oxidation reactions proceeding in a cathodic electrolytic treatment and an anodic electrolytic treatment, and therefore are generally added to a chromium-plating bath as additives.

Since the aqueous solution, which is used in an electrolytic treatment, contains the fluorine-containing compound and sulfuric acid, the coating weight of the chromium oxide layer of the obtained steel sheet for can making in terms of metallic chromium can be controlled in a predetermined range. Performing a cathodic electrolytic treatment in a bath containing hexavalent chromium ions allows the chromium oxide layer to be formed at the outermost layer together with the metallic chromium layer. It is known that increasing the amount of additives added to the bath reduces the thickness of the chromium oxide layer at the outermost layer. The reason for this is not clear but is probably because anions are assumed to have the effect of chemically dissolving the chromium oxide layer during immersion in the bath and the increase in amount of the anions reduces the amount of an oxide.

The hexavalent chromium compound, which is contained in the aqueous solution, is not particularly limited. Examples of the hexavalent chromium compound include chromium trioxide ($CrO_3$), dichromates such as potassium dichromate ($K_2Cr_2O_7$), and chromates such as potassium chromate ($K_2CrO_4$).

The content of the hexavalent chromium compound in the aqueous solution is preferably 0.14 mol/L to 3.0 mol/L and more preferably 0.30 mol/L to 2.5 mol/L as the amount of Cr.

The fluorine-containing compound, which is contained in the aqueous solution, is not particularly limited. Examples of the fluorine-containing compound include hydrofluoric acid (HF), potassium fluoride (KF), sodium fluoride (NaF), silicohydrofluoric acid ($H_2SiF_6$), and/or salts thereof. Examples of the salts of silicohydrofluoric acid include sodium silicofluoride ($Na_2SiF_6$), potassium silicofluoride ($K_2SiF_6$), and ammonium silicofluoride ($(NH_4)_2SiF_6$).

The content of the fluorine-containing compound in the aqueous solution is preferably 0.02 mol/L to 0.43 mol/L and more preferably 0.08 mol/L to 0.40 mol/L as the amount of F.

The content of sulfuric acid or the sulfate in the aqueous solution is preferably 0.0001 mol/L to 0.1 mol/L, more preferably 0.0003 mol/L to 0.05 mol/L, and further more preferably 0.001 mol/L to 0.05 mol/L as the amount of a sulfate ion (the amount of $SO_4^{2-}$). The sulfate is not particularly limited. Examples of the sulfate include sodium sulfate and ammonium sulfate.

Sulfate ions in the aqueous solution improve the electrolysis efficiency of deposition of the metallic chromium layer when used in combination with the fluorine-containing compound. When the content of the sulfate ions in the aqueous solution is in the above range, the maximum diameter of the granular protrusions of metallic chromium precipitated in the posterior cathodic electrolytic treatment is likely to be controlled in an appropriate range.

Furthermore, the sulfate ions affect the formation of generation sites of the granular protrusions of metallic chromium in the anodic electrolytic treatment. When the content of the sulfate ions in the aqueous solution is in the above range, the granular protrusions of metallic chromium are unlikely to be excessively fine or coarse and an appropriate number density is more likely to be obtained.

When no sulfuric acid or sulfate is contained in the aqueous solution except sulfuric acid or a sulfate (derived from a raw material) that is inevitably contained in the aqueous solution, fluoride ions in the aqueous solution affect the dissolution of hydrated chromium oxide during immersion and the dissolution of metallic chromium during the anodic electrolytic treatment and significantly affect the morphology of metallic chromium precipitated in the subsequent cathodic electrolytic treatment. However, the fluoride ions are less effective in dissolving hydrated chromium oxide and in dissolving metallic chromium in the anodic electrolytic treatment as compared to sulfuric acid. Therefore, the contact resistance is likely to be high because of the increase in amount of hydrated chromium oxide and the refinement of granular metallic chromium. Thus, in the disclosed embodiments, from the viewpoint of reducing the contact resistance, particularly the sheet-sheet contact resistance, manufacture in a bath containing sulfuric acid is preferable rather than manufacture in a bath containing no sulfuric acid.

Raw materials such as chromium trioxide are inevitably contaminated with sulfuric acid in an industrial production stage. Therefore, in a case where these raw materials are used, sulfuric acid is inevitably contained in the aqueous solution. The amount of sulfuric acid inevitably contained in the aqueous solution is preferably less than 0.001 mol/L and more preferably less than 0.0001 mol/L.

In the anterior cathodic electrolytic treatment, the anodic electrolytic treatment, and the posterior cathodic electrolytic treatment, only one type of aqueous solution is preferably used.

The temperature of the aqueous solution used in each electrolytic treatment is preferably 20° C. to 80° C. and more preferably 40° C. to 60° C.

(Anterior Cathodic Electrolytic Treatment)

In the anterior cathodic electrolytic treatment, the metallic chromium layer (the flat-like metallic chromium sublayer and the granular metallic chromium sublayer) and the chromium oxide layer are precipitated. In this operation, from the viewpoint of obtaining an appropriate amount of precipitation and the viewpoint of ensuring the appropriate thickness of the flat-like metallic chromium sublayer, the charge density (the product of the current density and the energization time) in the anterior cathodic electrolytic treatment is preferably 20 C/dm$^2$ to 50 C/dm$^2$ and more preferably 25 C/dm$^2$ to 45 C/dm$^2$.

Incidentally, the current density (unit: A/dm$^2$) and the energization time (unit: sec.) are appropriately set from the above charge density.

The anterior cathodic electrolytic treatment need not be any continuous electrolytic treatment. That is, the anterior cathodic electrolytic treatment may be an intermittent electrolytic treatment in which electrolysis is performed using a plurality of separate electrodes in view of industrial production and therefore the electroless immersion time is inevitably present. In the case of the intermittent electrolytic treatment, the total charge density is preferably in the above range.

(Anodic Electrolytic Treatment)

The anodic electrolytic treatment has a role in dissolving the metallic chromium layer precipitated in the anterior cathodic electrolytic treatment to form the generation sites of the granular protrusions of the granular metallic chromium sublayer. In this operation, when dissolution in the anodic electrolytic treatment is too intense, the number of the generation sites decreases to reduce the number density of the granular protrusions per unit area or dissolution proceeds nonuniformly to vary the distribution of the granular protrusions in some cases.

The metallic chromium layer formed by the anterior cathodic electrolytic treatment and the anodic electrolytic treatment mainly includes the flat-like metallic chromium sublayer. In order to adjust the thickness of the flat-like metallic chromium sublayer to 7 nm or more, which is a preferable range, a metallic chromium amount of 50 mg/m$^2$ or more is preferably ensured after the anterior cathodic electrolytic treatment and the cathodic electrolytic treatment.

From the above viewpoint, the charge density (the product of the current density and the energization time) in the anodic electrolytic treatment is preferably more than 3.3 C/dm$^2$ to less than 5.0 C/dm$^2$. The charge density in the anodic electrolytic treatment is more preferably more than 0.3 C/dm$^2$; to 3.0 C/dm$^2$ and further more preferably more than 0.3 C/dm$^2$ to 2.0 C/dm$^2$.

Incidentally, the current density (unit: A/dm$^2$) and the energization time (unit: sec.) are appropriately set from the above charge density.

The anodic electrolytic treatment need not be any continuous electrolytic treatment. That is, the anodic electrolytic treatment may be an intermittent electrolytic treatment in which electrolysis is performed using a plurality of separate electrodes in view of industrial production and therefore the electroless immersion time is inevitably present. In the case of the intermittent electrolytic treatment, the total charge density is preferably in the above range.

(Posterior Cathodic Electrolytic Treatment)

As described above, in the cathode electrolytic treatment, the metallic chromium layer and the chromium oxide layer are precipitated. In particular, in the posterior cathodic electrolytic treatment, the granular protrusions of the granular metallic chromium sublayer are formed using the generation sites of the granular protrusions of the above-mentioned granular metallic chromium sublayer as origins. In this operation, when the current density and the charge density are too high, the granular protrusions of the granular metallic chromium sublayer grow rapidly and the diameter thereof is large in some cases.

From the above viewpoint, the current density in the posterior cathodic electrolytic treatment is preferably less than 60.0 $A/dm^2$. The current density in the posterior cathodic electrolytic treatment is more preferably less than 50.0 $A/dm^2$ and further more preferably less than 40.0 $A/dm^2$. The lower limit thereof is not particularly limited and is preferably 10.0 $A/dm^2$ or more and more preferably 15.0 $A/dm^2$ or more.

For the same reason as the above, the charge density in the posterior cathodic electrolytic treatment is preferably less than 30.0 $C/dm^2$. The charge density in the posterior cathodic electrolytic treatment is more preferably 25.0 $C/dm^2$ or less and further more preferably 7.0 $C/dm^2$ or less. The lower limit thereof is not particularly limited and is preferably 1.0 $C/dm^2$ or more and more preferably 2.0 $C/dm^2$ or more.

Incidentally, the energization time (unit: sec.) is appropriately set from the above current density and charge density.

The posterior cathodic electrolytic treatment need not be any continuous electrolytic treatment. That is, the posterior cathodic electrolytic treatment may be an intermittent electrolytic treatment in which electrolysis is performed using a plurality of separate electrodes in view of industrial production and therefore the electroless immersion time is inevitably present. In the case of the intermittent electrolytic treatment, the total charge density is preferably in the above range.

In the disclosed embodiments, after the posterior cathodic electrolytic treatment, the steel sheet may be subjected to an immersion treatment in such a manner that the steel sheet is immersed in an aqueous solution containing a hexavalent chromium compound in an electroless mode or an electrolytic treatment (second electrolytic treatment) using a second solution of chromium plating bath for the purpose of controlling the amount of the chromium oxide layer and modifying the chromium oxide layer. Even if the immersion treatment or the second electrolytic treatment is performed, the thickness of the flat-like metallic chromium sublayer, the number density or the granular protrusions of the granular metallic chromium sublayer per unit area, and the maximum diameter or the granular protrusions are not at all affected.

The hexavalent chromium compound contained in the aqueous solution used in the above immersion treatment or second electrolytic treatment is not particularly limited. Examples of the hexavalent chromium compound include chromium trioxide ($CrO_3$), dichromates such as potassium dichromate ($K_2Cr_2O_7$), and chromates such as potassium chromate ($K_2CrO_4$)

EXAMPLES

The disclosed embodiments are described below in detail with reference to examples. However, the disclosed embodiments are not intended to be limited to these specific examples.

Temper grade T4CA steel sheets manufactured so as to have a thickness of 0.22 mm were degreased and pickled in a usual mode.

Next, in order to form iron-nickel diffusion layers, the steel sheets were nickel-plated and were then annealed. In nickel-plating, a Watts bath containing 250 g/L nickel sulfate ($NiSO_4 \cdot 6H_2O$), 45 g/L nickel chloride ($NiCl_2 \cdot 6H_2O$), and 30 g/L boric acid ($H_3BO_3$) was used; electroplating was performed under conditions including a bath temperature of 60° C., a pH of 4.5, and a current density of 10 $A/dm^2$; and the nickel coating weight was varied by adjusting the electrolysis time. Thereafter, the nickel-plated steel sheets were annealed. Annealing conditions were as shown in Table 1. The coating weight of nickel contained in each iron-nickel diffusion layer and the thickness of the iron-nickel diffusion layer were varied by varying the nickel coating weight and the annealing conditions. For comparison, conditions, such as performing annealing without nickel-plating and performing nickel-plating after annealing, for not forming any desired iron-nickel diffusion layer were set.

Next, in order to form metallic chromium layers and chromium oxide layers, the steel sheets were subjected to an electrolytic treatment under conditions shown in Table 1 using a lead electrode in such a manner that an aqueous solution shown in Table 2 was circulated with a pump in a flow cell, at about 100 mpm, whereby steel sheets for can making that were TFS were prepared.

Incidentally, a first electrolytic treatment (a series of an anterior cathodic electrolytic treatment, an anodic electrolytic treatment, and a posterior cathodic electrolytic treatment) was set as a standard condition and some were further subjected to a second electrolytic treatment after the first electrolytic treatment. The prepared steel sheets for can making were water-washed and were dried at room temperature using a blower.

The prepared steel sheets for can making were measured for the nickel coating weight of each iron-nickel diffusion layer by X-ray fluorescence spectrometry.

The thickness of the iron-nickel diffusion layer was measured by GDS. Measurement conditions for GDS were as described below. A method for calculating the thickness of the iron-nickel diffusion layer was as described above (see FIG. 1).

Instrument: GDA750 manufactured by Rigaku Corporation
Inside diameter of anode: 4 mm
Analysis mode: high-frequency, low-voltage mode
Discharge power: 40 W
Control pressure: 2.9 hPa
Detector: photomultiplier tube
Detection wavelength: Ni=341.4 nm In each prepared steel sheet for can making, the coating weight of the metallic chromium layer and the coating weight of the chromium oxide layer in terms of metallic chromium were measured. A measurement method was as described above. Furthermore, a granular metallic chromium sublayer of the metallic chromium layer was measured for the number density of granular protrusions per unit area and the maximum diameter thereof. A measurement method was as described above.

The obtained steel sheets for can making were evaluated as described below.

(1) Coating Coverage

A sample was cut from each prepared steel sheet for can making and was immersed in a 5% copper sulfate solution at 30° C. for one minute. Thereafter, the sample was water-washed, was dried, and was analyzed for the amount of precipitation of copper with an X-ray fluorescence spectrometer. Coating coverage was evaluated in accordance with standards below depending on the amount of precipitation of copper. In practical use, "⊙⊙", "⊙", or "○" can be rated excellent in coating coverage in a flat state. When coating coverage is bad, primary rust prevention performance in storing a steel sheet for can making after manufacture is poor, which is a practical problem for the steel sheet for can making.

⊙⊙: less than 20 mg/m$^2$

⊙: 20 mg/m$^2$ to less than 30 mg/m$^2$

○: 30 mg/m$^2$ to less than 40 mg/m$^2$

Δ: 40 mg/m$^2$ to less than 60 mg/m$^2$ x: 60 mg/m$^2$ or more (2) Post-Working Corrosion Resistance A sample taken from each prepared steel sheet for can making was Erichsen-formed at an indentation depth of 4 mm. Thereafter, the sample for evaluation was aged for seven days in a constant-temperature, constant-humidity chamber with a temperature of 40° C. and a relative humidity of 80%. Thereafter, the rust area fraction was determined from a photograph obtained by observing an Erichsen-formed portion with an optical microscope at low magnification by image analysis and was evaluated in accordance with standards below. In practical use, "⊙⊙", "⊙", or "○" can be rated excellent in rust resistance.

⊙⊙: a rust area fraction of less than 1%

⊙: a rust area fraction of 1% to less than 2%

○: a rust area fraction of 2% to less than 5%

Δ: a rust area fraction of 5% to less than 10% x: a rust area fraction of 10% or more (3) Weldability

The prepared steel sheets for can making were heat-treated at 210° C. for ten minutes on the assumption of a coating-baking step and were measured for contact resistance. First, samples of each steel sheet for can making were fed to a film laminating machine with a roll pressure of 4 kg/cm$^2$ at a feed rate of 40 mpm under such conditions that the surface temperature of a sheet having passed between rolls was 160° C. Next, the samples were post-heated in a batch oven (held at an attained temperature of 210° C. for 120 seconds). Thereafter, after the heat-treated samples were lapped over each other, were interposed between electrodes which were obtained by processing DR-type one mass percent Cr—Cu electrodes and which had a tip diameter of 6 mm and a curvature R of 40 mm, and were held for 15 seconds with a pressing force of 1 kgf/cm$^2$, the samples were energized with 10 A and the sheet-sheet contact resistance and the sheet-electrode contact resistance were measured. Ten points were measured and the average was taken as the contact resistance, which was evaluated in accordance with standards below. In practical use, "⊙⊙", "⊙", or "○" can be rated excellent in weldability.

⊙⊙: a contact resistance of 100μΩ or less

⊙: a contact resistance of more than 100μΩ to 500μΩ or less

○: a contact resistance of more than 500μΩ to 1,000μΩ or less

Δ: a contact resistance of more than 1,000μΩ to 3,000μΩ or less x: a contact resistance of more than 1,000μΩ

Manufacturing conditions and evaluation results were as shown in Tables 1-1 and 1-2. Aqueous solutions used in electrolytic treatments were as shown in Table 2.

TABLE 1-1

| | Unannealed nickel plating | Annealing conditions | | Annealed nickel plating | First electrolytic treatment | | | | | | | | | | |
|---|---|---|---|---|---|---|---|---|---|---|---|---|---|---|---|
| | | | | | | | Anterior cathodic electrolytic treatment | | | Anodic electrolytic treatment | | | Posterior cathodic electrolytic treatment | | |
| | Nickel coating weight mg/m$^2$ | Soaking temperature ° C. | Soaking holding time sec. | Nickel coating weight mg/m$^2$ | Aqueous solution | Temperature ° C. | Current density A/dm$^2$ | Energization time sec. | Charge density C/dm$^2$ | Current density A/dm$^2$ | Energization time sec. | Charge density C/dm$^2$ | Current density A/dm$^2$ | Energization time sec. | Charge density C/dm$^2$ |
| Example 1 | 70 | 700 | 20 | — | A | 45 | 30 | 1.20 | 36.0 | 1 | 0.50 | 0.5 | 30 | 0.30 | 9.0 |
| Example 2 | 70 | 700 | 20 | — | A | 45 | 30 | 1.20 | 36.0 | 2 | 0.50 | 1 | 30 | 0.30 | 9.0 |
| Example 3 | 70 | 700 | 20 | — | A | 45 | 30 | 1.20 | 36.0 | 4 | 0.50 | 2 | 30 | 0.30 | 9.0 |
| Example 4 | 70 | 700 | 20 | — | A | 45 | 30 | 1.40 | 42.0 | 1 | 0.50 | 0.5 | 30 | 0.30 | 9.0 |
| Example 5 | 70 | 700 | 20 | — | A | 45 | 30 | 1.40 | 42.0 | 1 | 0.50 | 0.5 | 30 | 0.30 | 9.0 |
| Example 6 | 200 | 700 | 20 | — | A | 45 | 30 | 1.40 | 42.0 | 1 | 0.50 | 0.5 | 30 | 0.30 | 9.0 |
| Example 7 | 400 | 700 | 20 | — | A | 45 | 30 | 1.40 | 42.0 | 1 | 0.50 | 0.5 | 30 | 0.30 | 9.0 |
| Example 8 | 500 | 700 | 20 | — | A | 45 | 30 | 1.40 | 42.0 | 1 | 0.50 | 0.5 | 30 | 0.30 | 9.0 |
| Example 9 | 500 | 700 | 30 | — | A | 45 | 30 | 1.40 | 42.0 | 1 | 0.50 | 0.5 | 30 | 0.30 | 9.0 |
| Example 10 | 50 | 700 | 20 | — | A | 45 | 30 | 1.40 | 42.0 | 1 | 0.50 | 0.5 | 30 | 0.30 | 9.0 |
| Comparative Example 1 | 30 | 700 | 20 | — | A | 45 | 30 | 1.40 | 42.0 | 1 | 0.50 | 0.5 | 30 | 0.30 | 9.0 |
| Comparative Example 2 | — | 700 | 20 | 500 | A | 45 | 30 | 1.40 | 42.0 | 1 | 0.50 | 0.5 | 30 | 0.30 | 9.0 |
| Comparative Example 3 | — | 700 | 20 | — | A | 45 | 30 | 1.40 | 42.0 | 1 | 0.50 | 0.5 | 30 | 0.30 | 9.0 |
| Comparative Example 4 | — | 700 | 20 | — | A | 45 | 30 | 2.00 | 60.0 | — | — | — | — | — | — |
| Compar- | — | 700 | 20 | — | A | 45 | 30 | 2.00 | 60.0 | — | — | — | — | — | — |

TABLE 1-1-continued

| | Unannealed nickel plating Nickel coating weight mg/m² | Annealing conditions Soaking temperature ° C. | Annealing conditions Soaking holding time sec. | Annealed nickel plating Nickel coating weight mg/m² | First electrolytic treatment: Aqueous solution | First electrolytic treatment: Temperature ° C. | First electrolytic treatment: Anterior cathodic electrolytic treatment: Current density A/dm² | First electrolytic treatment: Anterior cathodic electrolytic treatment: Energization time sec. | First electrolytic treatment: Anterior cathodic electrolytic treatment: Charge density C/dm² | First electrolytic treatment: Anodic electrolytic treatment: Current density A/dm² | First electrolytic treatment: Anodic electrolytic treatment: Energization time sec. | First electrolytic treatment: Anodic electrolytic treatment: Charge density C/dm² | First electrolytic treatment: Posterior cathodic electrolytic treatment: Current density A/dm² | First electrolytic treatment: Posterior cathodic electrolytic treatment: Energization time sec. | First electrolytic treatment: Posterior cathodic electrolytic treatment: Charge density C/dm² |
|---|---|---|---|---|---|---|---|---|---|---|---|---|---|---|---|
| ative Example 5 | | | | | | | | | | | | | | | |
| Comparative Example 6 | 70 | 700 | 20 | — | A | 45 | 30 | 2.00 | 60.0 | — | — | — | — | — | — |
| Comparative Example 7 | 70 | 700 | 20 | — | A | 45 | 30 | 2.00 | 60.0 | — | — | — | — | — | — |
| Example 11 | 70 | 700 | 20 | — | C | 45 | 30 | 1.40 | 42.0 | 1 | 0.50 | 0.5 | 30 | 0.30 | 9.0 |
| Example 12 | 200 | 700 | 20 | — | C | 45 | 30 | 1.40 | 42.0 | 1 | 0.50 | 0.5 | 30 | 0.30 | 9.0 |
| Example 13 | 500 | 700 | 20 | — | C | 45 | 30 | 1.40 | 42.0 | 1 | 0.50 | 0.5 | 30 | 0.30 | 9.0 |
| Example 14 | 70 | 700 | 20 | — | D | 45 | 30 | 1.40 | 42.0 | 1 | 0.50 | 0.5 | 30 | 0.30 | 9.0 |
| Example 15 | 200 | 700 | 20 | — | D | 45 | 30 | 1.40 | 42.0 | 1 | 0.50 | 0.5 | 30 | 0.30 | 9.0 |
| Example 16 | 500 | 700 | 20 | — | D | 45 | 30 | 1.40 | 42.0 | 1 | 0.50 | 0.5 | 30 | 0.30 | 9.0 |
| Example 17 | 70 | 700 | 20 | — | D | 45 | 30 | 1.40 | 42.0 | 1 | 0.50 | 0.5 | 40 | 0.30 | 12.0 |
| Example 18 | 70 | 700 | 20 | — | D | 45 | 30 | 1.40 | 42.0 | 1 | 0.50 | 0.5 | 50 | 0.30 | 15.0 |

30

TABLE 1-2

| | Second electrolytic treatment: Aqueous solution | Second electrolytic treatment: Temperature ° C. | Second electrolytic treatment: Cathodic electrolytic treatment: Current density A/dm² | Second electrolytic treatment: Cathodic electrolytic treatment: Energization time sec. | Second electrolytic treatment: Cathodic electrolytic treatment: Charge density C/dm² | Iron-nickel diffusion layer: Nickel weight mg/m² | Iron-nickel diffusion layer: Thickness of diffusion layer μm | Metallic chromium layer: Chromium coating weight mg/m² | Metallic chromium layer: Granular metallic chromium sublayer: Number density/μm² | Metallic chromium layer: Granular metallic chromium sublayer: maximum diameter nm | Chromium oxide layer: Chromium coating weight mg/m² | Evaluation: Coating coverage | Evaluation: Post-working corrosion resistance | Evaluation: Weldability: Sheet-sheet contact resistance | Evaluation: Weldability: Sheet-electrode contact resistance |
|---|---|---|---|---|---|---|---|---|---|---|---|---|---|---|---|
| Example 1 | — | — | — | — | — | 70 | 0.105 | 68 | 10 | 80 | 7 | ○ | ◎ | ◎◎ | ◎ |
| Example 2 | — | — | — | — | — | 70 | 0.105 | 78 | 8 | 90 | 7 | ○ | ◎ | ◎◎ | ◎ |
| Example 3 | — | — | — | — | — | 70 | 0.105 | 78 | 7 | 100 | 7 | ○ | ◎ | ◎◎ | ◎ |
| Example 4 | B | 45 | 3 | 0.30 | 0.9 | 70 | 0.105 | 110 | 10 | 85 | 8 | ◎ | ◎ | ◎◎ | ○ |
| Example 5 | B | 45 | 6 | 0.30 | 1.8 | 70 | 0.105 | 111 | 12 | 80 | 10 | ◎ | ◎ | ◎ | ○ |
| Example 6 | — | — | — | — | — | 200 | 0.211 | 105 | 10 | 80 | 6 | ◎ | ◎◎ | ◎◎ | ◎ |
| Example 7 | — | — | — | — | — | 400 | 0.405 | 104 | 10 | 80 | 7 | ◎ | ◎◎ | ◎◎ | ◎ |
| Example 8 | — | — | — | — | — | 500 | 0.450 | 100 | 10 | 80 | 6 | ◎ | ◎◎ | ◎◎ | ◎ |
| Example 9 | — | — | — | — | — | 500 | 0.485 | 106 | 10 | 80 | 5 | ◎ | ◎◎ | ◎◎ | ◎ |
| Example 10 | — | — | — | — | — | 50 | 0.060 | 111 | 12 | 95 | 6 | ○ | ○ | ◎◎ | ◎ |
| Comparative Example 1 | — | — | — | — | — | 30 | 0.035 | 101 | 15 | 100 | 5 | ○ | × | ◎◎ | ◎ |
| Comparative Example 2 | — | — | — | — | — | 500 | 0.056 | 102 | 16 | 100 | 6 | ○ | Δ | ◎◎ | ◎ |
| Comparative | B | 45 | 6 | 0.60 | 3.6 | — | — | 115 | 20 | 100 | 12 | ○ | Δ | ◎ | Δ |

TABLE 1-2-continued

| | Second electrolytic treatment | | | | | Iron-nickel diffusion layer | | Metallic chromium layer | | | Chromium oxide layer | Evaluation | | | |
|---|---|---|---|---|---|---|---|---|---|---|---|---|---|---|---|
| | | | Cathodic electrolytic treatment | | | | | | Granular metallic chromium sublayer | | | | | Weldability | |
| | Aqueous solution | Temperature ° C. | Current density A/dm$^2$ | Energization time sec. | Charge density C/dm$^2$ | Nickel weight mg/m$^2$ | Thickness of diffusion layer μm | Chromium coating weight mg/m$^2$ | Number density/μm$^2$ | maximum diameter nm | Chromium coating weight mg/m$^2$ | Coating coverage | Post-working corrosion resistance | Sheet-sheet contact resistance | Sheet-electrode contact resistance |
| Example 3 Comparative | — | — | — | — | — | — | — | 102 | — | — | 5 | Δ | × | × | × |
| Example 4 Comparative | B | 45 | 10 | 0.60 | 6.0 | — | — | 115 | — | — | 16 | ○ | Δ | × | × |
| Example 5 Comparative | — | — | — | — | — | 70 | 0.105 | 97 | — | — | 4 | ○ | ◎ | × | × |
| Example 6 Comparative | B | 45 | 10 | 0.60 | 6.0 | 70 | 0.105 | 108 | — | — | 15 | ◎ | ◎ | × | × |
| Example 7 | | | | | | | | | | | | | | | |
| Example 11 | — | — | — | — | — | 70 | 0.105 | 95 | 16 | 65 | 10 | ◎ | ◎ | ○ | ○ |
| Example 12 | — | — | — | — | — | 200 | 0.211 | 92 | 15 | 70 | 10 | ◎ | ◎◎ | ○ | ○ |
| Example 13 | — | — | — | — | — | 500 | 0.500 | 89 | 15 | 70 | 10 | ◎ | ◎◎ | ○ | ○ |
| Example 14 | — | — | — | — | — | 70 | 0.105 | 87 | 22 | 50 | 11 | ◎ | ◎ | ○ | ○ |
| Example 15 | — | — | — | — | — | 200 | 0.211 | 85 | 20 | 50 | 12 | ◎ | ◎◎ | ○ | ○ |
| Example 16 | — | — | — | — | — | 500 | 0.500 | 83 | 20 | 50 | 12 | ◎ | ◎◎ | ○ | ○ |
| Example 17 | — | — | — | — | — | 70 | 0.105 | 101 | 16 | 60 | 13 | ◎◎ | ◎ | ○ | ○ |
| Example 18 | — | — | — | — | — | 70 | 0.105 | 115 | 12 | 70 | 14 | ◎◎ | ◎ | ○ | ○ |

TABLE 2

| Aqueous solution | Composition: Bath | mol/L: Cr | F | $SO_4^{2-}$ |
|---|---|---|---|---|
| A | $CrO_3$ 180 g/L<br>$Na_2SiF_6$ 6.5 g/L<br>$H_2SO_4$ 1.0 g/L | 1.80 | 0.207 | 0.0102 |
| B | $CrO_3$ 50 g/L<br>$NH_4F$ 2.0 g/L | 0.50 | 0.054 | — |
| C | $CrO_3$ 180 g/L<br>$Na_2SiF_6$ 6.5 g/L | 1.80 | 0.207 | — |
| D | $CrO_3$ 50 g/L<br>$NH_4F$ 2.0 g/L | 0.50 | 0.054 | — |

As is apparent from the results shown in Table 1, it was clear that all Examples were excellent in weldability and post-working corrosion resistance.

The invention claimed is:

1. A steel sheet for can making, comprising an iron nickel diffusion layer, a metallic chromium layer, and a chromium oxide layer on at least one surface of the steel sheet in order from a steel sheet side, wherein the iron nickel diffusion layer has a nickel coating weight in a range of 50 mg/m$^2$ to 500 mg/m$^2$ per surface of the steel sheet and a thickness in a range of 0.060 μm to 0.500 μm per surface of the steel sheet, the metallic chromium layer includes a flat metallic chromium sublayer and a granular metallic chromium sublayer placed on a surface of the flat metallic chromium sublayer, a total chromium coating weight of both sublayers per surface of the steel sheet is in a range of 60 mg/m$^2$ to 200 mg/m$^2$, the granular metallic chromium sublayer including granular protrusions having a number density in a range of 5 μm$^{-2}$ or more per unit area and a maximum diameter of 150 nm or less, the chromium oxide layer has a chromium coating weight in a range of 3 mg/m$^2$ to 10 mg/m$^2$ per surface of the steel sheet in terms of metallic chromium, and a rust area fraction of the steel sheet is less than 5%, the rust area fraction of the steel sheet being measured by:

Erichsen-forming a sample taken from the steel sheet at an indentation depth of 4 mm, then aging the sample for seven days in a constant-temperature, constant-humidity chamber with a temperature of 40° C. and a relative humidity of 80%, and then determining the rust area fraction of the steel sheet from a photograph obtained by observing an Erichsen-formed portion with an optical microscope at low magnification by image analysis.

* * * * *